US009388358B2

(12) United States Patent
Shea et al.

(10) Patent No.: US 9,388,358 B2
(45) **Date of Patent: *Jul. 12, 2016**

(54) HIGH OCTANE UNLEADED AVIATION GASOLINE

(71) Applicant: SHELL OIL COMPANY, Houston, TX (US)

(72) Inventors: Timothy Michael Shea, The Woodlands, TX (US); Trevor James Davies, Frodsham (GB); Michael Clifford Macknay, Chester (GB); Hanane Belmokaddem Bennis, Richmond, TX (US)

(73) Assignee: Shell Oil Company, Houston, TX (US)

( * ) Notice: Subject to any disclaimer, the term of this patent is extended or adjusted under 35 U.S.C. 154(b) by 48 days.

This patent is subject to a terminal disclaimer.

(21) Appl. No.: 14/340,882

(22) Filed: Jul. 25, 2014

(65) Prior Publication Data

US 2015/0175921 A1 Jun. 25, 2015

Related U.S. Application Data

(60) Provisional application No. 61/898,258, filed on Oct. 31, 2013, provisional application No. 61/991,900, filed on May 12, 2014.

(51) Int. Cl.

| | |
|---|---|
| ***C10L 1/16*** | (2006.01) |
| ***C10L 1/223*** | (2006.01) |
| ***C10L 1/182*** | (2006.01) |
| ***C10L 10/10*** | (2006.01) |
| ***C10L 1/02*** | (2006.01) |
| ***C10L 1/00*** | (2006.01) |
| ***C10L 1/18*** | (2006.01) |
| ***C10L 1/22*** | (2006.01) |
| ***C10L 10/14*** | (2006.01) |
| *C10L 1/19* | (2006.01) |

(52) U.S. Cl.

CPC . *C10L 10/10* (2013.01); *C10L 1/00* (2013.01); *C10L 1/02* (2013.01); *C10L 1/16* (2013.01); *C10L 1/18* (2013.01); *C10L 1/22* (2013.01); *C10L 1/223* (2013.01); *C10L 10/14* (2013.01); *C10L 1/1608* (2013.01); *C10L 1/19* (2013.01); *C10L 2200/0259* (2013.01); *C10L 2200/0415* (2013.01); *C10L 2230/22* (2013.01); *C10L 2270/023* (2013.01); *C10L 2270/04* (2013.01)

(58) Field of Classification Search

CPC ..... C10L 10/10; C10L 10/14; C10L 1/02; C10L 1/16; C10L 1/1616; C10L 1/10; C10L 1/1608; C10L 1/223; C10L 2200/0259; C10L 2270/023; C10L 2270/04; C10L 1/19; C10L 2300/40; C10L 2200/042

USPC ..... 585/1, 14; 44/451.452; 123/1 A

See application file for complete search history.

(56) References Cited

U.S. PATENT DOCUMENTS

| | | | | |
|---|---|---|---|---|
| 7,611,551 | B2 | 11/2009 | Gaughan et al. | |
| 7,918,990 | B2 | 4/2011 | Seyfried et al. | |
| 8,628,594 | B1 | 1/2014 | Braly | |
| 2003/0183554 | A1* | 10/2003 | Bazzani | C10L 1/02 208/16 |
| 2008/0134571 | A1* | 6/2008 | Landschof | C10L 1/023 44/424 |
| 2008/0172931 | A1* | 7/2008 | Bazzani | C10L 1/023 44/447 |
| 2008/0244963 | A1 | 10/2008 | Demoment et al. | |
| 2010/0263262 | A1 | 10/2010 | Gaughan | |
| 2012/0080000 | A1 | 4/2012 | Landschof et al. | |
| 2013/0111805 | A1 | 5/2013 | Mathur et al. | |

FOREIGN PATENT DOCUMENTS

| | | |
|---|---|---|
| EP | 1650289 | 4/2006 |
| GB | 2334262 | 8/1999 |
| WO | 02022766 | 3/2000 |
| WO | 2010118408 | 10/2010 |

OTHER PUBLICATIONS

U.S. Appl. No. 14/340,911, filed Jul. 25, 2014, Shea et al.
U.S. Appl. No. 14/340,830, filed Jul. 25, 2014, Shea et al.
U.S. Appl. No. 14/340,731, filed Jul. 25, 2014, Shea et al.
UK-IPO Search and Examination Report dated Sep. 19, 2014, Application No. GB1413241.9.
US 8,313,540, 11/2012, Rusek et al. (withdrawn).

* cited by examiner

*Primary Examiner* — Pamela H Weiss

(57) ABSTRACT

High octane unleaded aviation gasoline having low aromatics content and a T10 of at most 75° C., T40 of at least 75° C., a T50 of at most 105° C., a T90 of at most 135° C., a final boiling point of less than 190° C., an adjusted heat of combustion of at least 43.5 MJ/kg, a vapor pressure in the range of 38 to 49 kPa and a freezing point of less than −58° C. is provided.

12 Claims, No Drawings

HIGH OCTANE UNLEADED AVIATION GASOLINE

This present application claims the benefit of U.S. Patent Application Nos. 61/898,258 filed Oct. 31, 2013, and 61/991,900 filed May 12, 2014, the entire disclosures of which are incorporated herein by reference.

FIELD OF THE INVENTION

The present invention relates to high octane unleaded aviation gasoline fuel, in particular to a high octane unleaded aviation gasoline having low aromatics content.

BACKGROUND OF THE INVENTION

Avgas (aviation gasoline), is an aviation fuel used in spark-ignited internal-combustion engines to propel aircraft. Avgas is distinguished from mogas (motor gasoline), which is the everyday gasoline used in cars and some non-commercial light aircraft. Unlike mogas, which has been formulated since the 1970s to allow the use of 3-way catalytic converters for pollution reduction, avgas contains tetraethyl lead (TEL), a non-biodegradable toxic substance used to prevent engine knocking (detonation).

Aviation gasoline fuels currently contain the additive tetraethyl lead (TEL), in amounts up to 0.53 mL/L or 0.56 g/L which is the limit allowed by the most widely used aviation gasoline specification 100 Low Lead (100LL). The lead is required to meet the high octane demands of aviation piston engines: the 100LL specification ASTM D910 demands a minimum motor octane number (MON) of 99.6, in contrast to the EN 228 specification for European motor gasoline which stipulates a minimum MON of 85 or United States motor gasoline which require unleaded fuel minimum octane rating (R+M)/2 of 87.

Aviation fuel is a product which has been developed with care and subjected to strict regulations for aeronautical application. Thus aviation fuels must satisfy precise physico-chemical characteristics, defined by international specifications such as ASTM D910 specified by Federal Aviation Administration (FAA). Automotive gasoline is not a fully viable replacement for avgas in many aircraft, because many high-performance and/or turbocharged airplane engines require 100 octane fuel (MON of 99.6) and modifications are necessary in order to use lower-octane fuel. Automotive gasoline can vaporize in fuel lines causing a vapor lock (a bubble in the line) or fuel pump cavitation, starving the engine of fuel. Vapor lock typically occurs in fuel systems where a mechanically-driven fuel pump mounted on the engine draws fuel from a tank mounted lower than the pump. The reduced pressure in the line can cause the more volatile components in automotive gasoline to flash into vapor, forming bubbles in the fuel line and interrupting fuel flow.

The ASTM D910 specification does not include all gasoline satisfactory for reciprocating aviation engines, but rather, defines the following specific types of aviation gasoline for civil use: Grade 80; Grade 91; Grade 100; and Grade 100LL. Grade 100 and Grade 100LL are considered High Octane Aviation Gasoline to meet the requirement of modern demanding aviation engines. In addition to MON, the D910 specification for Avgas have the following requirements: density; distillation (initial and final boiling points, fuel evaporated, evaporated temperatures $T_{10}$, $T_{40}$, $T_{90}$, $T_{10}+T_{50}$); recovery, residue, and loss volume; vapor pressure; freezing point; sulfur content; net heat of combustion; copper strip corrosion; oxidation stability (potential gum and lead precipitate); volume change during water reaction; and electrical conductivity. Avgas fuel is typically tested for its properties using ASTM tests:

Motor Octane Number: ASTM D2700
Aviation Lean Rating: ASTM D2700
Performance Number (Super-Charge): ASTM D909
Tetraethyl Lead Content: ASTM D5059 or ASTM D3341
Color: ASTM D2392
Density: ASTM D4052 or ASTM D1298
Distillation: ASTM D86
Vapor Pressure: ASTM D5191 or ASTM D323 or ASTM D5190
Freezing Point: ASTM D2386
Sulfur: ASTM D2622 or ASTM D1266
Net Heat of Combustion (NHC): ASTM D3338 or ASTM D4529 or ASTM D4809
Copper Corrosion: ASTM D130
Oxidation Stability—Potential Gum: ASTM D873
Oxidation Stability—Lead Precipitate: ASTM D873
Water Reaction—Volume change: ASTM D1094
Electrical Conductivity: ASTM D2624

Aviation fuels must have a low vapor pressure in order to avoid problems of vaporization (vapor lock) at low pressures encountered at altitude and for obvious safety reasons. But the vapor pressure must be high enough to ensure that the engine starts easily. The Reid Vapor pressure (RVP) should be in the range of 38 kPa to 49 kPA. The final distillation point must be fairly low in order to limit the formations of deposits and their harmful consequences (power losses, impaired cooling). These fuels must also possess a sufficient Net Heat of Combustion (NHC) to ensure adequate range of the aircraft. Moreover, as aviation fuels are used in engines providing good performance and frequently operating with a high load, i.e. under conditions close to knocking, this type of fuel is expected to have a very good resistance to spontaneous combustion.

Moreover, for aviation fuel two characteristics are determined which are comparable to octane numbers: one, the MON or motor octane number, relating to operating with a slightly lean mixture (cruising power), the other, the Octane rating. Performance Number or PN, relating to use with a distinctly richer mixture (take-off). With the objective of guaranteeing high octane requirements, at the aviation fuel production stage, an organic lead compound, and more particularly tetraethyllead (TEL), is generally added. Without the TEL added, the MON is typically around 91. As noted above ASTM D910, 100 octane aviation fuel requires a minimum motor octane number (MON) of 99.6. The distillation profile of the high octane unleaded aviation fuel composition should have a T10 of maximum 75° C., T40 of minimum 75° C., T50 of maximum 105° C., and T90 of maximum 135° C.

As in the case of fuels for land vehicles, administrations are tending to lower the lead content, or even to ban this additive, due to it being harmful to health and the environment. Thus, the elimination of lead from the aviation fuel composition is becoming an objective.

SUMMARY OF THE INVENTION

It has been found that it is difficult to produce a high octane unleaded aviation fuel that meet most of the ASTM D910 specification for high octane aviation fuel. In addition to the MON of 99.6, it is also important to not negatively impact the flight range of the aircraft, vapor pressure, temperature profile and freeze points that meet the aircraft engine start up requirements and continuous operation at high altitude.

In accordance with certain of its aspects, in one embodiment of the present invention provides an unleaded aviation fuel composition having a MON of at least 99.6, sulfur content of less than 0.05 wt %, a T10 of at most 75° C., T40 of at least 75° C., a T50 of at most 105° C., a T90 of at most 135° C., a final boiling point of less than 190° C., an adjusted heat of combustion of at least 43.5 MJ/kg, a vapor pressure in the range of 38 to 49 kPa, comprising a blend comprising:

from about 5 vol. % to about 20 vol. % of toluene having a MON of at least 107;

from about 2 vol. % to about 10 vol. % of aniline;

from about 35 vol. % to about 65 vol. % of at least one alkylate or alkylate blend having an initial boiling range of from about 32° C. to about 60° C. and a final boiling range of from about 105° C. to about 140° C., having T40 of less than 99° C., T50 of less than 100° C., T90 of less than 110° C., the alkylate or alkylate blend comprising isoparaffins from 4 to 9 carbon atoms, about 3-20 vol. % of C5 isoparaffins, about 3-15 vol. % of C7 isoparaffins, and about 60-90 vol. % of C8 isoparaffins, based on the alkylate or alkylate blend, and less than 1 vol. % of C10+, based on the alkylate or alkylate blend;

from about 5 vol. % to about 20 vol. % of a diethyl carbonate with the proviso that the combined toluene and diethyl carbonate content less aniline content is greater than 20 vol. %; and at least 8 vol. % of isopentane in an amount sufficient to reach a vapor pressure in the range of 38 to 49 kPa;

wherein the fuel composition contains less than 1 vol. % of C8 aromatics.

The features and advantages of the invention will be apparent to those skilled in the art. While numerous changes may be made by those skilled in the art, such changes are within the spirit of the invention.

DETAILED DESCRIPTION OF THE INVENTION

We have found that a high octane low aromatics unleaded aviation fuel that meets most of the ASTM D910 specification for 100 octane aviation fuel can be produced by a blend comprising from about 5 vol. % to about 20 vol. % of high MON toluene, from about 2 vol. % to about 10 vol. % of aniline, from about 35 vol. % to about 65 vol. % of at least one alkylate cut or alkylate blend that have certain composition and properties, at least 8 vol. % of isopentane and 5 vol. % to 20 vol. % of diethyl carbonate (DEC) with the proviso that the combined toluene and diethyl carbonate content less aniline content is greater than 20 vol. %, preferably at least 22 vol. %, more preferably at least 25 vol. %, based on the unleaded fuel composition. The high octane unleaded aviation fuel of the invention has a MON of greater than 99.6.

Further the unleaded aviation fuel composition contains less than 1 vol. %, preferably less than 0.5 vol. % of C8 aromatics. It has been found that C8 aromatics such as xylene may have materials compatibility issues, particularly in older aircraft. Further it has been found that unleaded aviation fuel containing C8 aromatics tend to have difficulties meeting the temperature profile of D910 specification. In one embodiment, the unleaded aviation fuel contains less than 0.2 vol. % of alcohols. In another embodiment, the unleaded aviation fuel contains no noncyclic ethers. In one embodiment, the unleaded aviation fuel contains no alcohols having boiling point of less than 80° C. In another embodiment, the unleaded aviation fuel composition contains no other oxygenates other than diethyl carbonate and aviation fuel system icing inhibitor additives.

Further, the unleaded aviation fuel composition has a benzene content between 0% v and 5% v, preferably less than 1% v.

Further, in some embodiments, the volume change of the unleaded aviation fuel tested for water reaction is within +/−2 mL as defined in ASTM D1094.

The high octane unleaded fuel will not contain lead and preferably not contain any other metallic octane boosting lead equivalents. The term "unleaded" is understood to contain less than 0.01 g/L of lead. The high octane unleaded aviation fuel will have a sulfur content of less than 0.05 wt %. In some embodiments, it is preferred to have ash content of less than 0.0132 g/L (0.05 g/gallon) (ASTM D-482).

According to current ASTM D910 specification, the NHC should be close to or above 43.5 mJ/kg. The Net Heat of Combustion value is based on a current low density aviation fuel and does not accurately measure the flight range for higher density aviation fuel. It has been found that for unleaded aviation gasolines that exhibit high densities, the heat of combustion may be adjusted for the higher density of the fuel to more accurately predict the flight range of an aircraft.

There are currently three approved ASTM test methods for the determination of the heat of combustion within the ASTM D910 specification. Only the ASTM D4809 method results in an actual determination of this value through combusting the fuel. The other methods (ASTM D4529 and ASTM D3338) are calculations using values from other physical properties. These methods have all been deemed equivalent within the ASTM D910 specification.

Currently the Net Heat of Combustion for Aviation Fuels (or Specific Energy) is expressed gravimetrically as MJ/kg. Current lead containing aviation gasolines have a relatively low density compared to many alternative unleaded formulations. Fuels of higher density have a lower gravimetric energy content but a higher volumetric energy content (MJ/L).

The higher volumetric energy content allows greater energy to be stored in a fixed volume. Space can be limited in general aviation aircraft and those that have limited fuel tank capacity, or prefer to fly with full tanks, can therefore achieve greater flight range. However, the more dense the fuel, then the greater the increase in weight of fuel carried. This could result in a potential offset of the non-fuel payload of the aircraft. Whilst the relationship of these variables is complex, the formulations in this embodiment have been designed to best meet the requirements of aviation gasoline. Since in part density effects aircraft range, it has been found that a more accurate aircraft range, normally gauged using Heat of Combustion, can be predicted by adjusting for the density of the avgas using the following equation:

$$HOC^{*}=(HOC_{v}/\text{density})+(\%\ \text{range increase}/\%\ \text{payload increase}+1)$$

where HOC* is the adjusted Heat of Combustion (MJ/kg), $HOC_v$ is the volumetric energy density (MJ/L) obtained from actual Heat of Combustion measurement, density is the fuel density (g/L), % range increase is the percentage increase in aircraft range compared to 100 LL ($HOC_{LL}$) calculated using $HOC_v$ and $HOC_{LL}$ for a fixed fuel volume, and % payload increase is the corresponding percentage increase in payload capacity due to the mass of the fuel.

The adjusted heat of combustion will be at least 43.5 MJ/kg, and have a vapor pressure in the range of 38 to 49 kPa. The high octane unleaded fuel composition will further have a freezing point of −58° C. or less. Further, the final boiling point of the high octane unleaded fuel composition should be less than 190° C., preferably at most 180° C. measured with greater than 98.5% recovery as measured using ASTM D-86. If the recovery level is low, the final boiling point may not be effectively measured for the composition (i.e., higher boiling residual still remaining rather than being measured). The high octane unleaded aviation fuel composition of the invention have a Carbon, Hydrogen, and Nitrogen content (CHN content) of at least 91.8 wt %, preferably 93.8 wt %, less than 8.2 wt %, preferably 6.2 wt % or less of oxygen content. In one embodiment, the unleaded aviation fuel composition of the invention contains no other oxygenates than diethyl carbonate and fuel system icing inhibitor additives which are typically added in 0.1 to 0.15 vol. % range. Suitably, the unleaded aviation fuel has aromatics content measured according to ASTM D5134 from about 5 wt % to about 20 wt %.

It has been found that the high octane unleaded aviation fuel of the invention not only meets the MON value for 100 octane aviation fuel, but also meets the freeze point and the temperature profile of T10 of at most 75° C., T40 of at least 75° C., T50 at most 105° C., and T90 of at most 135° C., vapor pressure, adjusted heat of combustion, and freezing point. In addition to MON it is important to meet the vapor pressure, temperature profile, and minimum adjusted heat of combustion for aircraft engine start up and smooth operation of the plane at higher altitude. Preferably the potential gum value is less than 6 mg/100 mL.

It is difficult to meet the demanding specification for unleaded high octane aviation fuel. For example, US Patent Application Publication 2008/0244963, discloses a lead-free aviation fuel with a MON greater than 100, with major components of the fuel made from avgas and a minor component of at least two compounds from the group of esters of at least one mono- or poly-carboxylic acid and at least one mono- or polyol, anhydrides of at least one mono- or poly carboxylic acid. These oxygenates have a combined level of at least 15% v/v, typical examples of 30% v/v, to meet the MON value. However, these fuels do not meet many of the other specifications such as heat of combustion (measured or adjusted) at the same time, including even MON in many examples. Another example, U.S. Pat. No. 8,313,540 discloses a biogenic turbine fuel comprising mesitylene and at least one alkane with a MON greater than 100. However, these fuels also do not meet many of the other specifications such as heat of combustion (measured or adjusted), temperature profile, and vapor pressure at the same time.

Toluene

Toluene occurs naturally at low levels in crude oil and is usually produced in the processes of making gasoline via a catalytic reformer, in an ethylene cracker or making coke from coal. Final separation, either via distillation or solvent extraction, takes place in one of the many available processes for extraction of the BTX aromatics (benzene, toluene and xylene isomers). The toluene used in the invention must be a grade of toluene that have a MON of at least 107 and containing less than 1 vol % of C8 aromatics. Further, the toluene component preferably has a benzene content between 0% v and 5% v, preferably less than 1% v.

For example an aviation reformate is generally a hydrocarbon cut containing at least 70% by weight, ideally at least 85% by weight of toluene, and it also contains C8 aromatics (15 to 50% by weight ethylbenzene, xylenes) and C9 aromatics (5 to 25% by weight propyl benzene, methyl benzenes and trimethylbenzenes). Such reformate has a typical MON value in the range of 102-106, and it has been found not suitable for use in the present invention.

Toluene is preferably present in the blend in an amount from 5% v, preferably at least about 10% v, most preferably at least about 12% v to at most about 20% v, preferably to at most about 18% v, more preferably to at most about 16% v, based on the unleaded aviation fuel composition.

Aniline

Aniline ($C_6H_5NH_2$) is mainly produced in industry in two steps from benzene. First, benzene is nitrated using a concentrated mixture of nitric acid and sulfuric acid at 50 to 60° C., which gives nitrobenzene. In the second step, the nitrobenzene is hydrogenated, typically at 200-300° C. in presence of various metal catalysts.

As an alternative, aniline is also prepared from phenol and ammonia, the phenol being derived from the cumene process.

In commerce, three brands of aniline are distinguished: aniline oil for blue, which is pure aniline; aniline oil for red, a mixture of equimolecular quantities of aniline and ortho- and para-toluidines; and aniline oil for safranin, which contains aniline and ortho-toluidine, and is obtained from the distillate (échappés) of the fuchsine fusion. Pure aniline, otherwise known as aniline oil for blue is desired for high octane unleaded avgas. Aniline is preferably present in the blend in an amount from about 2% v, preferably at least about 3% v, most preferably at least about 4% v to at most about 10% v, preferably to at most about 7% v, more preferably to at most about 6% v, based on the unleaded aviation fuel composition.

Alkylate and Alkyate Blend

The term alkylate typically refers to branched-chain paraffin. The branched-chain paraffin typically is derived from the reaction of isoparaffin with olefin. Various grades of branched chain isoparaffins and mixtures are available. The grade is identified by the range of the number of carbon atoms per molecule, the average molecular weight of the molecules, and the boiling point range of the alkylate. It has been found that a certain cut of alkylate stream and its blend with isoparaffins such as isooctane is desirable to obtain or provide the high octane unleaded aviation fuel of the invention. These alkylate or alkylate blend can be obtained by distilling or taking a cut of standard alkylates available in the industry. It is optionally blended with isooctane. The alkylate or alkyate blend have an initial boiling range of from about 32° C. to about 60° C. and a final boiling range of from about 105° C. to about 140° C., preferably to about 135° C., more preferably to about 130° C., most preferably to about 125° C.), having T40 of less than 99° C., preferably at most 98° C., T50 of less than 100° C., T90 of less than 110° C., preferably at most 108° C., the alkylate or alkylate blend comprising isoparaffins from 4 to 9 carbon atoms, about 3-20 vol. % of C5 isoparaffins, based on the alkylate or alkylate blend, about 3-15 vol. % of C7 isoparaffins, based on the alkylate or alkylate blend, and about 60-90 vol. % of C8 isoparaffins, based on the alkylate or alkylate blend, and less than 1 vol. % of C10+, preferably less than 0.1 vol. %, based on the alkylate or alkylate blend. Alkylate or alkylate blend is preferably present in the blend in an amount from about 36% v, preferably at least about 40% v, most preferably at least about 43% v to at most about 65% v, preferably to at most about 49% v, more preferably to at most about 48% v.

Isopentane

Isopentane is present in an amount of at least 8 vol % in an amount sufficient to reach a vapor pressure in the range of 38 to 49 kPa. The alkylate or alkylate blend also contains C5 isoparaffins so this amount will typically vary between 5 vol. % and 25 vol. % depending on the C5 content of the alkylate or alkylate blend. Isopentane should be present in an amount to reach a vapor pressure in the range of 38 to 49 kPa to meet aviation standard. The total isopentane content in the blend is typically in the range of 10 vol. % to 26 vol. %, preferably in the range of 17% to 22% by volume, based on the aviation fuel composition.

Co-solvent

Diethyl carbonate (DEC) is present in an amount of 10 vol. % to 20 vol. % based on the unleaded aviation fuel with the proviso that the combined toluene and diethyl carbonate content is at least 20 vol. %, preferably at least 30 vol. %. DEC is preferably present in the fuel in an amount from about 5 vol. %, preferably at least about 12 vol. %, more preferably at least about 15 vol. %, to at most about 20 vol. %, preferably to at most about 18 vol. %. Diethyl carbonate can be obtained by reacting phosgene and ethyl alcohol to produce ethyl chlorocarbonate followed by reaction with anhydrous ethyl alcohol at elevated temperatures. In another method, diethyl carbonate is obtained by reacting ethanol and supercritical carbon dioxide in the presence of potassium carbonate a transesterification of propylene carbonate and methanol. Diethyl carbonate is available commercially for example from Sigma Aldrich Company. The unleaded aviation fuels containing aromatic amines tend to be significantly more polar in nature than traditional aviation gasoline base fuels. As a result, they have poor solubility in the fuels at low temperatures, which can dramatically increase the freeze points of the fuels. Consider for example an aviation gasoline base fuel comprising 10% v/v isopentane, 70% v/v light alkylate and 20% v/v toluene. This blend has a MON of around 90 to 93 and a freeze point (ASTM D2386) of less than −76° C. The addition of 6% w/w (approximately 4% v/v) of the aromatic amine aniline increases the MON to 96.4. At the same time, however, the freeze point of the resultant blend (again measured by ASTM D2386) increases to −12.4° C. The current standard specification for aviation gasoline, as defined in ASTM D910, stipulates a maximum freeze point of −58° C. Therefore, simply replacing TEL with a relatively large amount of an alternative aromatic octane booster would not be a viable solution for an unleaded aviation gasoline fuel. It has been found that branched chain alkyl acetates having an alkyl group of 4 to 8 carbon atoms dramatically decrease the freezing point of the unleaded aviation fuel to meet the current ASTM D910 standard for aviation fuel.

Preferably the water reaction volume change is within +/−2 ml for aviation fuel. Water reaction volume change is large for ethanol that makes ethanol not suitable for aviation gasoline.

Blending

For the preparation of the high octane unleaded aviation gasoline, the blending can be in any order as long as they are mixed sufficiently. It is preferable to blend the polar components into the toluene, then the non-polar components to complete the blend. For example the aromatic amine and co-solvent are blended into toluene, followed by isopentane and alkylate component (alkylate or alkylate blend).

In order to satisfy other requirements, the unleaded aviation fuel according to the invention may contain one or more additives which a person skilled in the art may choose to add from standard additives used in aviation fuel. There should be mentioned, but in non-limiting manner, additives such as antioxidants, anti-icing agents, antistatic additives, corrosion inhibitors, dyes and their mixtures.

According to another embodiment of the present invention a method for operating an aircraft engine, and/or an aircraft which is driven by such an engine is provided, which method involves introducing into a combustion region of the engine and the high octane unleaded aviation gasoline fuel formulation described herein. The aircraft engine is suitably a spark ignition piston-driven engine. A piston-driven aircraft engine may for example be of the inline, rotary, V-type, radial or horizontally-opposed type.

While the invention is susceptible to various modifications and alternative forms, specific embodiments thereof are shown by way of examples herein described in detail. It should be understood, that the detailed description thereto are not intended to limit the invention to the particular form disclosed, but on the contrary, the intention is to cover all modifications, equivalents and alternatives falling within the spirit and scope of the present invention as defined by the appended claims. The present invention will be illustrated by the following illustrative embodiment, which is provided for illustration only and is not to be construed as limiting the claimed invention in any way.

ILLUSTRATIVE EMBODIMENT

Test Methods

The following test methods were used for the measurement of the aviation fuels.

Motor Octane Number: ASTM D2700
Tetraethyl Lead Content: ASTM D5059
Density: ASTM D4052
Distillation: ASTM D86
Vapor Pressure: ASTM D323
Freezing Point: ASTM D2386
Sulfur: ASTM D2622
Net Heat of Combustion (NHC): ASTM D3338
Copper Corrosion: ASTM D130
Oxidation Stability—Potential Gum: ASTM D873
Oxidation Stability—Lead Precipitate: ASTM D873
Water Reaction—Volume change: ASTM D1094
Detail Hydrocarbon Analysis (ASTM 5134)

Examples 1-3

The aviation fuel compositions of the invention were blended as follows. Toluene having 107 MON (from VP Racing Fuels Inc.) was mixed with Aniline (from Univar NV) while mixing.

Isooctane (from Univar NV) and Narrow Cut Alkylate having the properties shown in Table below (from Shell Nederland Chemie BV) were poured into the mixture in no particular order. Then, diethyl carbonate (from Chemsol) was added, followed by isopentane (from Matheson Tri-Gas, Inc.) to complete the blend.

TABLE 1

| Narrow Cut Alkylate Blend Properties | |
|---|---|
| IBP (ASTM D86, ° C.) | 39.1 |
| FBP (ASTM D86, ° C.) | 115.1 |
| T40 (ASTM D86, ° C.) | 94.1 |
| T50 (ASTM D86, ° C.) | 98 |
| T90 (ASTM D86, ° C.) | 105.5 |
| Vol % iso-C5 | 14.52 |

TABLE 1-continued

| Narrow Cut Alkylate Blend Properties | |
|---|---|
| Vol % iso-C7 | 7.14 |
| Vol % iso-C8 | 69.35 |
| Vol % C10+ | 0 |

Example 1

| | |
|---|---|
| Isopentane | 20% v |
| narrow cut alkylate | 23% v |
| Isooctane | 23% v |
| Toluene | 15% v |
| Aniline | 4% v |
| diethyl carbonate | 15% v |

| Property | |
|---|---|
| MON | 102.4 |
| RVP (kPa) | 38.82 |
| Freeze Point (deg C.) | <−65.5 |
| Lead Content (g/gal) | <0.01 |
| Density (g/mL) | 0.764 |
| Net Heat of Combustion (MJ/kg) | 43.6 |
| Adjusted Net Heat of Combustion (MJ/kg) | 45.5 |
| T10 (deg C.) | 71.7 |
| T40 (deg C.) | 100.8 |
| T50 (deg C.) | 102.8 |
| T90 (deg C.) | 123.2 |
| FBP (deg C.) | 179.7 |

Example 2

| | |
|---|---|
| Isopentane | 20% v |
| narrow cut alkylate | 23% v |
| Isooctane | 22% v |
| Toluene | 15% v |
| Aniline | 5% v |
| diethyl carbonate | 15% v |

| Property | |
|---|---|
| MON | 100.4 |
| RVP (kPa) | 40.89 |
| Freeze Point (deg C.) | <−65.5 |
| Lead Content (g/gal) | <0.01 |
| Density (g/mL) | 0.769 |
| Net Heat of Combustion (MJ/kg) | 43.6 |
| Adjusted Net Heat of Combustion (MJ/kg) | 45.6 |
| T10 (deg C.) | 60.7 |
| T40 (deg C.) | 100.8 |
| T50 (deg C.) | 103.9 |
| T90 (deg C.) | 114.6 |
| FBP (deg C.) | 179.5 |

Example 3

| | |
|---|---|
| Isopentane | 19% v |
| narrow cut alkylate | 24% v |
| Isooctane | 24% v |
| Toluene | 15% v |
| Aniline | 3% v |
| diethyl carbonate | 15% v |

| Property | |
|---|---|
| MON | 100.5 |
| RVP (kPa) | 46.815 |
| Freeze Point (deg C.) | <−34.5 |
| Lead Content (g/gal) | <0.01 |
| Density (g/mL) | 0.749 |
| Net Heat of Combustion (MJ/kg) | 43.258 |
| Adjusted Net Heat of Combustion (MJ/kg) | 45.04 |
| Water Reaction (mL) | 0 |
| T10 (deg C.) | 63.9 |
| T40 (deg C.) | 98.3 |
| T50 (deg C.) | 102.4 |
| T90 (deg C.) | 117.2 |
| FBP (deg C.) | 179.4 |

Properties of an Alkylate Blend

Properties of an Alkyalte Blend containing ½ narrow cut alkylate (having properties as shown above) and ½ Isooctane is shown in Table 2 below.

TABLE 2

| Alkylate Blend Properties | |
|---|---|
| IBP (ASTM D86, ° C.) | 54.0 |
| FBP (ASTM D86, ° C.) | 117.5 |
| T40 (ASTM D86, ° C.) | 97.5 |
| T50 (ASTM D86, ° C.) | 99.0 |
| T90 (ASTM D86, ° C.) | 102.5 |
| Vol % iso-C5 | 5.17 |
| Vol % iso-C7 | 3.60 |
| Vol % iso-C8 | 86.83 |
| Vol % C10+ | 0.1 |

Combustion Properties

In addition to the physical characteristics, an aviation gasoline should perform well in a spark ignition reciprocating aviation engine. A comparison to the current leaded aviation gasoline found commercially is the simplest way to assess the combustion properties of a new aviation gasoline.

Table 3 below provides the measured operating parameters on a Lycoming TIO-540 J2BD engine for avgas Example 3 and a commercially purchased 100 LL avgas (FBO100LL).

TABLE 3

| Fuel | Altitude (ft) | RPM | Fuel Consumption (lbs/hr) | CHT[a], Cyl 1 (° F.) | Turbine Inlet Temperature (° F.) | Brake Horsepower (Observed) | Brake Specific Fuel Consumption (lb./hp.-hr) |
|---|---|---|---|---|---|---|---|
| FBO 100LL | 6000 | 2199.98 | 128.42 | 457 | 1615 | 256.54 | 0.495 |
| Example 3 | 6000 | 2199.99 | 144.02 | 449 | 1610 | 261.53 | 0.551 |
| FBO 100LL | 12000 | 2400.01 | 184.19 | 461 | 1520 | 297.77 | 0.618 |

TABLE 3-continued

| Fuel | Altitude (ft) | RPM | Fuel Consumption (lbs/hr) | CHT[a], Cyl 1 (° F.) | Turbine Inlet Temperature (° F.) | Brake Horsepower (Observed) | Brake Specific Fuel Consumption (lb./hp.-hr) |
|---|---|---|---|---|---|---|---|
| Example 3 | 12000 | 2399.96 | 206.01 | 437 | 1512 | 297.52 | 0.692 |

[a]CHT = cylinder head temperature. Although testing was conducted on a six cylinder engine, the variation between 100LL and Example 3 results were similar over all six cylinders, so only cylinder 1 values are used for representation.

As can be seen from Table 3, the avgas of the invention provides similar engine operating characteristics compared to the leaded reference fuel. The data provided in Table 3 was generated using a Lycoming TIO-540 J2BD six cylinder reciprocating spark ignition aviation piston engine mounted on an engine test dynamometer. These results further demonstrate the ability of this fuel to operate in a similar fashion to leaded aviation gasoline.

Comparative Example A-N

Comparative Examples A and B

The properties of a high octane unleaded aviation gasoline that use large amounts of oxygenated materials as described in U. S. Patent Application Publication 2008/0244963 as Blend X4 and Blend X7 is provided. The reformate contained 14 vol. % benzene, 39 vol. % toluene and 47 vol. % xylene.

| Comparative Example A Blend X4 | Vol % | Comparative Example B Blend X7 | Vol % |
|---|---|---|---|
| Isopentane | 12.25 | Isopentane | 12.25 |
| Aviation alkylate | 43.5 | Aviation alkylate | 43.5 |
| Reformate | 14 | Reformate | 14 |
| Diethyl carbonate | 15 | Diethyl carbonate | 8 |
| m-toluidine | 3 | m-toluidine | 2 |
| MIBK | 12.46 | MIBK | 10 |
| | | phenatole | 10 |

| Property | Blend X4 | Blend X7 |
|---|---|---|
| MON | 100.4 | 99.3 |
| RVP (kPa) | 35.6 | 40.3 |
| Freeze Point (deg C.) | −51.0 | −70.0 |
| Lead Content (g/gal) | <0.01 | <0.01 |
| Density (g/mL) | 0.778 | 0.781 |
| Net Heat of Combustion (MJ/kg) | 38.017 | 39.164 |
| Adjusted Net Heat of Combustion (MJ/kg) | 38.47 | 39.98 |
| Oxygen Content (% m) | 8.09 | 6.16 |
| T10 (deg C.) | 73.5 | 73 |
| T40 (deg C.) | 102.5 | 104 |
| T50 (deg C.) | 106 | 108 |
| T90 (deg C.) | 125.5 | 152.5 |
| FBP (deg C.) | 198 | 183 |

The difficulty in meeting many of the ASTM D-910 specifications is clear given these results. Such an approach to developing a high octane unleaded aviation gasoline generally results in unacceptable drops in the heat of combustion value (>10% below ASTM D910 specification) and final boiling point. Even after adjusting for the higher density of these fuels, the adjusted heat of combustion remains too low.

Comparative Examples C and D

A high octane unleaded aviation gasoline that use large amounts of mesitylene as described as Swift 702 in U.S. Pat. No. 8,313,540 is provided as Comparative Example C. A high octane unleaded gasoline as described in Example 4 of US Patent Application Publication Nos. US20080134571 and US20120080000 are provided as Comparative Example D.

| Comparative Example C | Vol % | Comparative Example D | Vol % |
|---|---|---|---|
| Isopentane | 17 | Isopentane | 3.5 |
| Mesitylene | 83 | Isooctaane | 45.5 |
| | | Toluene | 23 |
| | | xylenes | 21 |
| | | aniline | 7 |

| Property | Comparative Example C | Comparative Example D |
|---|---|---|
| MON | 105 | 104 |
| RVP (kPa) | 35.16 | 17.79 |
| Freeze Point (deg C.) | −20.5 | −41.5 |
| Lead Content (g/gal) | <0.01 | <0.01 |
| Density (g/mL) | 0.830 | 0.794 |
| Net Heat of Combustion (MJ/kg) | 41.27 | 42.20 |
| Adjusted Net Heat of Combustion (MJ/kg) | 42.87 | 43.86 |
| T10 (deg C.) | 74.2 | 100.4 |
| T40 (deg C.) | 161.3 | 108.3 |
| T50 (deg C.) | 161.3 | 110.4 |
| T90 (deg C.) | 161.3 | 141.6 |
| FBP (deg C.) | 166.8 | 180.2 |

As can be seen from the properties, the Freeze Point is too high for both Comparative Examples C & D.

Comparative Examples E-N

Other comparative examples where the components were varied are provided below. As can been seem from the above and below examples, the variation in composition resulted in at least one of MON being too low, RVP being too high or low, Freeze Point being too high, or Heat of Combustion being too low.

| Comparative Example E | Vol % | Comparative Example F | Vol % |
|---|---|---|---|
| Isopentane | 10 | Isopentane | 15 |
| Aviation alkylate | 60 | Isooctane | 60 |
| m-xylene | 30 | Toluene | 25 |

| Property | Comparative Example E | Comparative Example F |
|---|---|---|
| MON | 93.6 | 95.4 |
| RVP (kPa) | 40 | 36.2 |
| Freeze Point (deg C.) | <−80 | <−80 |
| Lead Content (g/gal) | <0.01 | <0.01 |
| Density (g/mL) | 0.738 | 0.730 |
| Net Heat of Combustion (MJ/kg) | 43.11 | 43.27 |
| Adjusted Net Heat of Combustion (MJ/kg) | 44.70 | 44.83 |
| T10 (deg C.) | 68.4 | 76.4 |
| T40 (deg C.) | 106.8 | 98.7 |

-continued

| | | |
|---|---|---|
| T50 (deg C.) | 112 | 99.7 |
| T90 (deg C.) | 134.5 | 101.3 |
| FBP (deg C.) | 137.1 | 115.7 |

| Comparative Example G | Vol % | Comparative Example H | Vol % |
|---|---|---|---|
| Isopentane | 15 | Isopentane | 10 |
| Isooctane | 75 | Aviation alkylate | 69 |
| Toluene | 10 | toluene | 15 |
| | | m-toluidine | 6 |

| Property | Comparative Example G | Comparative Example H |
|---|---|---|
| MON | 96 | 100.8 |
| RVP (kPa) | 36.9 | 44.8 |
| Freeze Point (deg C.) | <−80 | −28.5 |
| Lead Content (g/gal) | <0.01 | <0.01 |
| Density (g/mL) | 0.703 | 0.729 |
| Net Heat of Combustion (MJ/kg) | 44.01 | 43.53 |
| Adjusted Net Heat of Combustion (MJ/kg) | 45.49 | 45.33 |
| T10 (deg C.) | 75.3 | 65 |
| T40 (deg C.) | 97.1 | 96.3 |
| T50 (deg C.) | 98.4 | 100.6 |
| T90 (deg C.) | 99.1 | 112.9 |
| FBP (deg C.) | 111.3 | 197.4 |

Comparative Example I

| Comparative Example I | Vol % |
|---|---|
| Isopentane | 15 |
| Narrow cut alkylate | 59 |
| Toluene | 10 |
| Diethyl carbonate | 10 |
| aniline | 6 |

| Property | Comparative Example I |
|---|---|
| MON | 101.4 |
| RVP (kPa) | 48.8 |
| Freeze Point (deg C.) | −25 |
| Lead Content (g/gal) | <0.01 |
| Density (g/mL) | 0.748 |
| Net Heat of Combustion (MJ/kg) | 43.45 |
| Adjusted Net Heat of Combustion (MJ/kg) | 45.31 |
| T10 (deg C.) | 60.9 |
| T40 (deg C.) | 96.3 |
| T50 (deg C.) | 101.7 |
| T90 (deg C.) | 125.5 |
| FBP (deg C.) | 194.4 |

Comparative Example J

| Comparative Example J | Vol % |
|---|---|
| Isopentane | 15 |
| Narrow cut alkylate | 62 |
| Toluene | 10 |
| Diethyl carbonate | 10 |
| aniline | 3 |

| Property | Comparative Example J |
|---|---|
| MON | 98 |
| RVP (kPa) | 48.3 |
| Freeze Point (deg C.) | −50.5 |
| Lead Content (g/gal) | <0.01 |
| Density (g/mL) | 0.738 |
| Net Heat of Combustion (MJ/kg) | 43.57 |
| Adjusted Net Heat of Combustion (MJ/kg) | 45.46 |
| T10 (deg C.) | 60.6 |
| T40 (deg C.) | 95.4 |
| T50 (deg C.) | 101.1 |
| T90 (deg C.) | 113 |
| FBP (deg C.) | 175 |

Comparative Example K

| Comparative Example K | Vol % |
|---|---|
| Isopentane | 15 |
| Narrow cut alkylate | 61 |
| Toluene | 10 |
| Diethyl carbonate | 10 |
| aniline | 4 |

| Property | Comparative Example K |
|---|---|
| MON | 98.8 |
| RVP (kPa) | 48.7 |
| Freeze Point (deg C.) | −40 |
| Lead Content (g/gal) | <0.01 |
| Density (g/mL) | 0.741 |
| Net Heat of Combustion (MJ/kg) | 43.51 |
| Adjusted Net Heat of Combustion (MJ/kg) | 45.38 |
| T10 (deg C.) | 61.2 |
| T40 (deg C.) | 95.2 |
| T50 (deg C.) | 101.1 |
| T90 (deg C.) | 115.9 |

Comparative Example L

| Comparative Example L | Vol % |
|---|---|
| Isopentane | 14 |
| Narrow cut alkylate | 62 |
| Toluene | 10 |
| Diethyl carbonate | 10 |
| aniline | 4 |

| Property | Comparative Example L |
|---|---|
| MON | 103 |
| RVP (kPa) | 48.33 |
| Freeze Point (deg C.) | −25.5 |
| Lead Content (g/gal) | <0.01 |
| Density (g/mL) | 0.749 |
| Net Heat of Combustion (MJ/kg) | 43.329 |
| Adjusted Net Heat of Combustion (MJ/kg) | 45.14 |
| T10 (deg C.) | 54.7 |
| T40 (deg C.) | 97.1 |
| T50 (deg C.) | 102.3 |
| T90 (deg C.) | 122.2 |
| FBP (deg C.) | 181.1 |

Comparative Example M

| Comparative Example M | Vol % |
|---|---|
| Isopentane | 14 |
| Narrow cut alkylate | 56 |
| Toluene | 15 |
| Diethyl carbonate | 10 |
| aniline | 5 |

| Property | Comparative Example M |
|---|---|
| MON | 101.3 |
| RVP (kPa) | 47.09 |
| Freeze Point (deg C.) | −42.5 |
| Lead Content (g/gal) | <0.01 |
| Density (g/mL) | 0.755 |
| Net Heat of Combustion (MJ/kg) | 43.191 |
| Adjusted Net Heat of Combustion (MJ/kg) | 44.97 |
| T10 (deg C.) | 35.7 |
| T40 (deg C.) | 98.2 |
| T50 (deg C.) | 102.6 |
| T90 (deg C.) | 118.6 |
| FBP (deg C.) | 178.8 |

Comparative Example N

| Comparative Example N | Vol % |
|---|---|
| Isopentane | 15 |
| Narrow cut alkylate | 60 |
| Toluene | 10 |
| Diethyl carbonate | 10 |
| aniline | 5 |

| Property | Comparative Example N |
|---|---|
| MON | 101.6 |
| RVP (kPa) | 48.4 |
| Freeze Point (deg C.) | −56.5 |
| Lead Content (g/gal) | <0.01 |
| Density (g/mL) | 0.745 |
| Net Heat of Combustion (MJ/kg) | 43.47 |
| Adjusted Net Heat of Combustion (MJ/kg) | 45.33 |
| T10 (deg C.) | 61.5 |
| T40 (deg C.) | 95.9 |
| T50 (deg C.) | 101.2 |
| T90 (deg C.) | 120.5 |
| FBP (deg C.) | 178.2 |

For example freezing point is low for Comparative Example M, where the amount of toluene and diethyl carbonate content less aniline content is 20 vol. %. (15 vol. %+10 vol. %−5 vol. %).

We claim:

1. An unleaded aviation fuel composition having a MON of at least 99.6, sulfur content of less than 0.05 wt %, a T10 of at most 75° C., T40 of at least 75° C., a T50 of at most 105° C., a T90 of at most 135° C., a final boiling point of less than 190° C., an adjusted heat of combustion of at least 43.5 MJ/kg, a vapor pressure in the range of 38 to 49 kPa, comprising a blend comprising:

from about 5 vol. % to about 20 vol. % of toluene having a MON of at least 107;

from about 2 vol. % to about 10 vol. % of aniline;

from about 35 vol. % to about 65 vol. % of at least one alkylate or alkylate blend having an initial boiling range of from about 32° C. to about 60° C. and a final boiling range of from about 105° C. to about 140° C., having T40 of less than 99° C., T50 of less than 100° C., T90 of less than 110° C., the alkylate or alkylate blend comprising isoparaffins from 4 to 9 carbon atoms, about 3-20 vol. % of C5 isoparaffins, about 3-15 vol. % of C7 isoparaffins, and about 60-90 vol. % of C8 isoparaffins, based on the alkylate or alkylate blend, and less than 1 vol. % of C10+, based on the alkylate or alkylate blend;

from about 5 vol. % to about 20 vol. % of a diethyl carbonate with the proviso that the combined toluene and diethyl carbonate content less aniline content is greater than 20 vol. %; and at least 8 vol. % of isopentane in an amount sufficient to reach a vapor pressure in the range of 38 to 49 kPa;

wherein the fuel composition contains less than 1 vol. % of C8 aromatics.

2. The unleaded aviation fuel composition of claim 1 wherein the total isopentane content in the blend of 10 vol. % to 26 vol. %.

3. The unleaded aviation fuel composition of claim 1 having a potential gum of less than 6 mg/100 mL.

4. The unleaded aviation fuel composition of claim 1 wherein less than 0.2 vol. % of alcohols are present.

5. The unleaded aviation fuel composition of claim 2 further comprising an aviation fuel additive.

6. The unleaded aviation fuel composition of claim 1 having a freezing point of less than −58° C.

7. The unleaded aviation fuel composition of claim 4 wherein no other oxygenates than diethyl carbonate and fuel system icing inhibitor additives are present.

8. The unleaded aviation fuel composition of claim 1 having a final boiling point of at most 180° C.

9. The unleaded aviation fuel composition of claim 1 wherein the alkylate or alkylate blend have a C10+ content of less than 0.1 vol. % based on the alkylate or alkylate blend.

10. The unleaded aviation fuel composition of claim 1 wherein the combined toluene and diethyl carbonate content less aniline content is at least 22 vol. %.

11. The unleaded aviation fuel composition of claim 1 having water reaction within +/−2 mL as defined in ASTM D1094.

12. The unleaded aviation fuel composition of claim 10 wherein the combined toluene and diethyl carbonate content less aniline content is at least 25 vol. %.

* * * * *